US005733391A

United States Patent [19]

Bass

[11] Patent Number: 5,733,391

[45] Date of Patent: Mar. 31, 1998

[54] QUENCHING METHOD

[75] Inventor: Robert W. Bass, Tolland, Conn.

[73] Assignee: Techxperts, Inc., Tolland, Conn.

[21] Appl. No.: 645,292

[22] Filed: May 13, 1996

[51] Int. Cl.[6] ..... C21D 1/00

[52] U.S. Cl. ..... 148/644; 148/660

[58] Field of Search ..... 148/637, 638, 148/644, 658, 660, 661; 266/96, 130, 131, 114

[56] References Cited

U.S. PATENT DOCUMENTS

| | | |
|---|---|---|
| 1,168,313 | 8/1916 | Kenworthy . |
| 1,601,497 | 4/1926 | Greene . |
| 2,087,978 | 8/1937 | Keller . |
| 2,407,230 | 9/1946 | Furkert . |
| 3,293,086 | 12/1966 | Seulen et al. . |
| 3,380,724 | 4/1968 | Cary . |
| 3,383,100 | 5/1968 | Balzer et al. . |
| 3,604,691 | 9/1971 | Sherwood . |

FOREIGN PATENT DOCUMENTS 61-3825 1/1986 Japan ..... 148/658

OTHER PUBLICATIONS

Garwood et al, Modelling of the Flow Distribution in an Oil Quench Tank, Journal of Materials Engineering and Performance, vol. 1(6), Dec. 1992, pp. 781–787.

Totten et al, Handbook of Quenchants and Quenching Technology, 1993, pp. 413–439, 333–335, and 335–337.

El-Genk et al, Saturated Pool Boiling From Downward-Facing and Inclined Surfaces, Institute for Space Nuclear Power Studies, ASME 1992, pp. 243–249.

*Primary Examiner*—Deborah Yee

*Attorney, Agent, or Firm*—Ira S. Dorman

[57] ABSTRACT

Thermal insulating gaseous blankets, generated by contact of a quench liquid with a hot metal workpiece, are displaced from downwardly directed surfaces by sequentially elevating the workpiece, at points about its periphery, so as to promote migration of the trapped gas across such surfaces. The improved heat transfer that results increases the levels of hardness and strength exhibited by the treated workpiece.

4 Claims, 2 Drawing Sheets

QUENCHING METHOD

BACKGROUND OF THE INVENTION

It is of course common practice to quench metals to increase their hardness and strength. In order to achieve the desired level of hardness, some alloys require the rapid quench that is best effected by immersion in a liquid bath.

A large, flat object, such as a gas turbine disk, must be lowered into a liquid quench bath in a fixture that supports it in a horizontal position; drooping distortion would otherwise tend to occur in the part, due to the relatively soft state in which the material exists at high temperature. Because the rate of heat transfer is so great in the initial stages of operation, the quench liquid will often boil upon contact with the workpiece. The resultant vapor readily rises away from surfaces that are directed laterally or upwardly (or at least generally so), and thereby permits fresh liquid to come into intimate contact with the hot metal, at those locations, to continue the cooling process. To escape from downwardly directed surfaces, however, the vapor must traverse the surface and then pass upwardly about the periphery of the workpiece; a substantial tendency therefore exists for vapor to become trapped on downwardly facing surfaces.

The presence of such a resulting blanket of stagnant gas will significantly reduce heat transfer on the underside of the workpiece, thereby increasing the time required to cool the lower portions and in turn limiting the degree of hardness that can be achieved in the quench operation. Among the techniques that are disclosed in the art for improving underside heat transfer efficiency, in recognition of these problems, are included the use of fluid-circulating jets (Garwood et al, *Modeling of the Flow Distribution in an Oil Quench Tank*, Journal of Materials Engineering and Performance, Volume 1(6), December 1992, pages 781–787), quenchant agitation (Totten et al, *Handbook of Quenchants and Quenching Technology*, 1993, pages 413–439), workpiece vibration (Totten et al, supra, pages 333–335), and the application of electric and magnetic fields (Totten et al, supra, pages 335–337). It is also known from El-Genk et al (*Saturated Pool Boiling From Downward-Facing and Inclined Surfaces*, Institute for Space Nuclear Power Studies, ASME 1992, pages 243–249) that heat transfer on a downward facing surface can be increased by inclining the surface.

The patent art does not appear to have adequately addressed problems associated with the thermal insulating effects of gaseous blankets generated by vaporization of quench liquids. The following U.S. patents are representative:

Kenworthy U.S. Pat. No. 1,168,313 discloses apparatus in which a platform tilts within a water-filled tank. Tilting serves to permit the workpiece to shift from one side of the platform to the other, thereby relocating it for elevation into a furnace chamber.

Furkert U.S. Pat. No. 2,407,230 provides heat-treating apparatus in which a receiving member tilts while submerged in a quench bath. The tilting action frees the workpiece (e.g., a gear) for sliding along an inclined rack within the bath.

Cary U.S. Pat. No. 3,380,724 provides a machine for hardening of crankshafts, which are rotated during the quenching operation for enhanced effect.

SUMMARY OF THE INVENTION

Accordingly, broad objects of the present invention are to provide an improved method and apparatus for hardening of metal workpieces by immersion in a quench liquid.

More specific objects of the invention are to provide such a method and apparatus for quenching workpieces having downwardly directed surface portions along which gases generated by vaporization of the quench liquid tend to become trapped.

Related objects are to provide such a method which is convenient and facile to carry out, and to provide such apparatus which is of incomplex and economical manufacture, which method and apparatus are highly effective in producing the desired results.

It has now been found that certain of the foregoing and related objects of the invention are attained by the provision of a method for metal hardening, wherein a hot metal workpiece is at least partially immersed in a quench liquid so as to submerge a downwardly directed bottom surface portion thereof, and is sequentially tilted, in each of a multiplicity of planes angularly displaced from one another about a vertical axis, so as to dynamically vary the orientation of the submerged surface portion. The temperature of the workpiece and the composition of the quench liquid are such that a quantity of the liquid vaporizes upon contact with the workpiece, and the bottom surface portion of the workpiece is of such character as to impede ready migration thereacross of the vapor that is thereby generated. Tilting of the immersed workpiece, as described, promotes migration, and thereby ultimate release, of the generated vapor.

The workpieces for which the method is employed will generally have a substantially flat bottom surface portion, which will normally be generally horizontally oriented in the untilted disposition of the workpiece. In preferred embodiments, the dynamic variation of orientation of the workpiece surface portion will occur continuously and through an infinite number of planes of tilting.

Other objects of the invention are attained by the provision of quenching apparatus comprising a container for a quench liquid, means for holding a workpiece, drive means associated with the container, and control means. The means for holding is adapted for immersion, in a liquid contained in the container, while maintaining at least a bottom surface portion of the workpiece exposed for liquid contact. The drive means is operatively connected for effecting tilting of the holding means, in each of a multiplicity of planes angularly displaced from one another about a vertical axis, and the control means is operatively connected to the drive means for controlling the sequential tilting of the holding means so as to dynamically vary its orientation. In the preferred apparatus the control means will be adapted to vary the orientation of the holding means continuously and through an infinite number of planes of tilting.

DETAILED DESCRIPTION OF THE ILLUSTRATED EMBODIMENT

Figure 1:
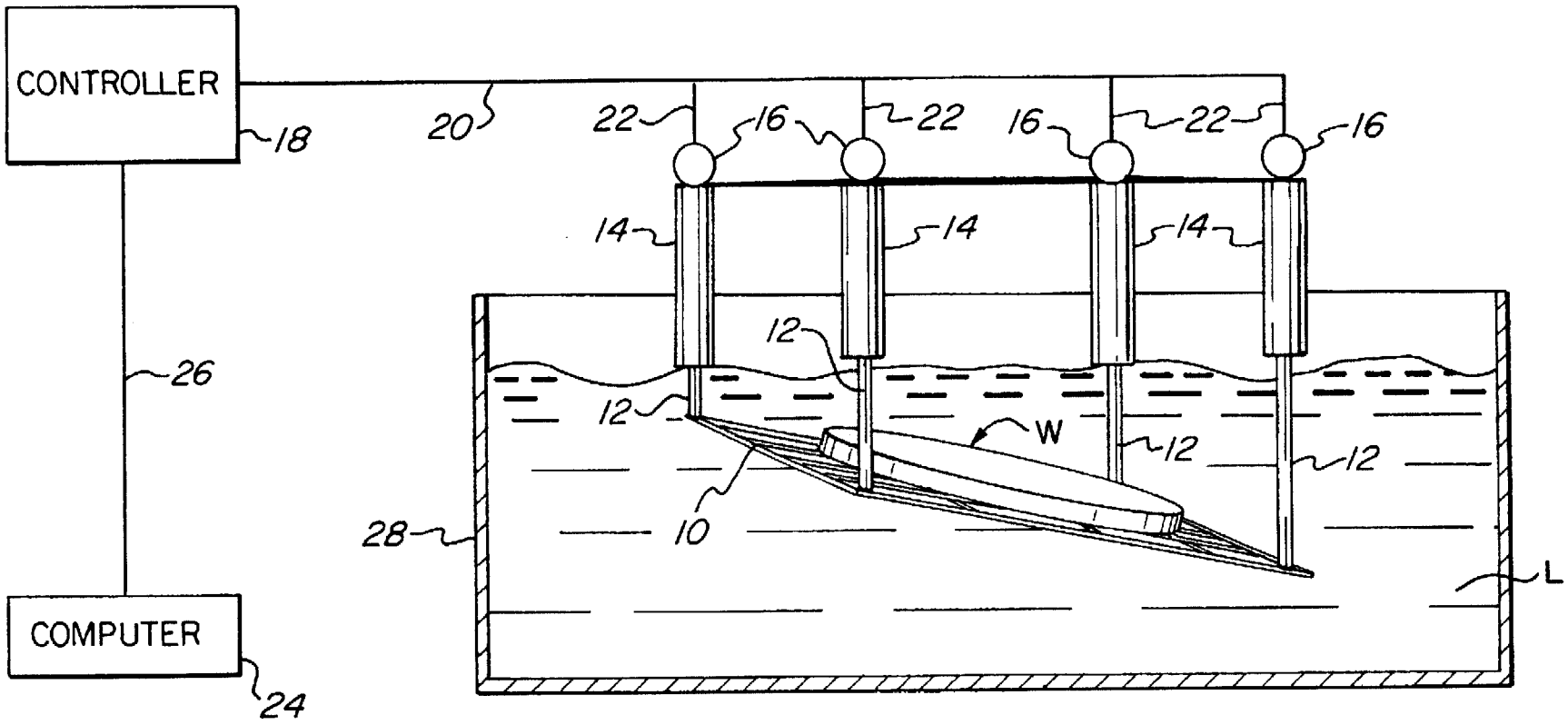
FIG. 1 is a diagrammatic perspective view of a system embodying the present invention, in use for quenching a turbine disk workpiece.

Turning now into detail to FIG. 1 of the appended drawings, therein illustrated is a system embodying the present invention and utilized for quenching of a circular metal disk W of the type that is employed for mounting of gas turbine blades. It will be appreciated that the system of the invention is suitable for use in quenching virtually any part having a lower surface portion (such as that designated S on disk W) that would, if downwardly directed, tend to impede the migration of gases generated thereon.

The apparatus illustrated consists of a supporting rectangular platform 10 of open, grid-like construction, having the rod 12 of an hydraulic piston 14 attached, for relative pivoting movement (by means not illustrated), at each of its four corners. An hydraulic motor 16 is operatively connected to the cylinder of each piston 14, and to a common controller 18 through lines 20 and 22, which controller 18 is in turn operatively connected to a computer 24 through cable 26. As can been seen, the platform 10, and thereby the disk W supported thereon, are submerged in a quench liquid L contained in the tank 28. Gases generated by vaporization of the quench liquid L will, in the absence of counteracting measures, tend to become trapped on the downwardly directed surface S of the disk W, so supported.

FIGS. 2A through 2D illustrate the positions of the platform 10 at each of four stages of an operating cycle of the system of FIG. 1. As dictated by the computer 24, the controller 18 energizes each of the motors 16 so as to sinusoidally reposition the rods 12 for continuous tilting of the platform 10, computer 24 being programmed to operate the pistons so that each is 90° out of phase with those adjacent to it (leading one and trailing the other).

Figure 2A:
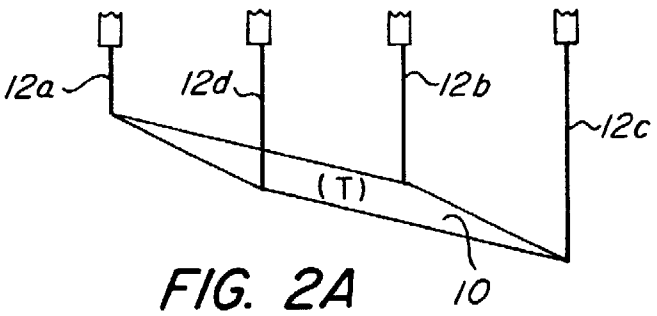
FIGS. 2A through 2D are diagrammatic perspective views of the supporting platform and piston rods of the system of FIG. 1, showing the sequence of dynamic tilting effected thereby.
Figure 2B:
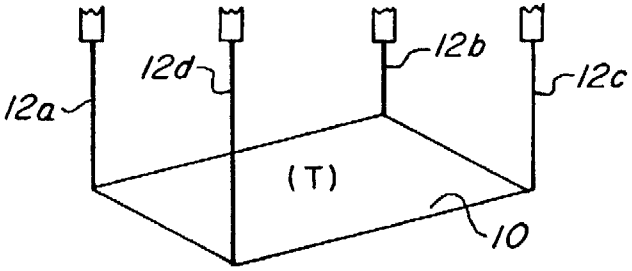
Figure 2C:
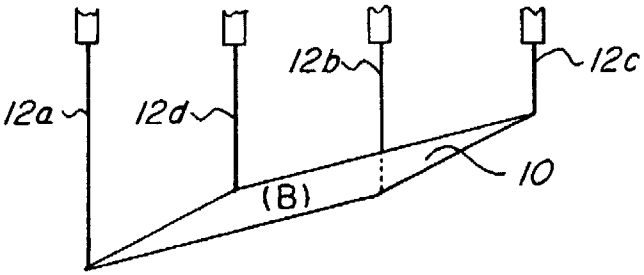
Figure 2D:
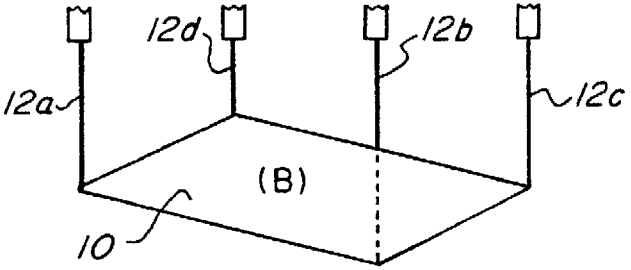
Figure 3:
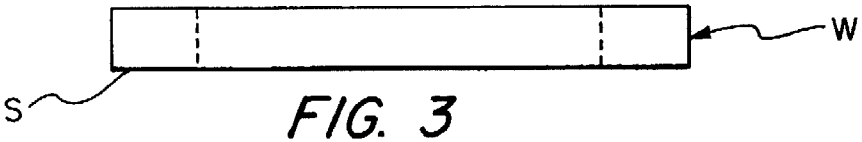
FIG. 3 is a diagrammatic side elevational view of a disk for a gas turbine blade assembly, constituting a typical workpiece for which the quenching method and apparatus of the invention are especially well suited.

FIG. 2A (which corresponds to the platform orientation of FIG. 1) shows the rod **12*a* in its fully retracted position; rods 12*b* and 12*d* are in intermediate positions, and rod 12*c* is fully extended. The stage depicted in FIG. 2B is attained after 90° of operation, rods 12*a* and 12*c* having moved to intermediate positions, rod 12*b* having been fully retracted, and rod 12*d* having been fully extended. In the stage shown in FIG. 2C (displaced 180° from that of FIG. 2A), rod 12*a* is fully extended, rod 12*c* is fully retracted, and rods 12*b* and 12*d* are both in intermediate positions, while in the final, 270° stage, rods 12*a* and 12*c* are in intermediate positions, rod 12*b* is fully extended, and rod 12*d* is fully retracted. It will be appreciated that the top of platform 10** is visible to the viewer in the orientations of FIGS. 2A and 2B (as indicated by the designation (T) thereon), and that the bottom is visible in FIGS. 2C and 2D (as indicated (B)).

It can be seen, therefore, that the technique of the invention effects a uniform and increased heat transfer on downwardly facing surfaces of a workpiece by periodic variation of its orientation. This is done in such manner that the point of highest inclination of the workpiece proceeds about its periphery (i.e., about the circumference of a circular part, such as disk W), thereby resulting in a time-averaged uniform condition on the lower surface, without affecting the conditions to which the upper surface is subjected. The frequency and amplitude of the motion imparted is so selected as to provide the workpiece with the desired heat transfer, and hence hardness.

Other methods for imparting dynamically varying inclination to a workpiece will be apparent to those skilled in the art, such as through the use of a rotating cam disposed beneath the workpiece platform, by use of a "wobble plate" supporting mechanism, by use of various mechanical suspension systems, and the like; suitable actuating and control means will, in each such instance, be apparent to those skilled in the art. The nature of the workpiece supporting means itself can of course vary widely from the platform illustrated, provided it affords adequate support for the workpiece while permitting necessary access by the quenching liquid to its downwardly directed surfaces. The concept of the invention is independent of the nature of the quench liquid, albeit that water will normally be employed.

Thus, it can be seen that the present invention provides an improved method, and an improved apparatus, for hardening of metal workpieces by immersion in a quench liquid, the workpieces having, more specifically, downwardly directed surface portions along which gases generated by vaporization of the quench liquid tend to become trapped. The method of the invention is convenient and facile to carry out, the apparatus is of incomplex and economical manufacture, and each is highly effective in producing the results desired.

Having thus described the invention, what is claimed is:

1. A method for hardening a hot metal workpiece, comprising the steps:

at least partially immersing a hot metal workpiece in a quench liquid so as to submerge a bottom surface portion thereof, the temperature of said workpiece and the composition of said quench liquid being such that a quantity of said quench liquid vaporizes upon contact with said workpiece, and said bottom surface portion being downwardly directed and being so oriented and of such character as to impede ready migration thereacross of the so-generated vapor; and effecting sequential tilting of said immersed workpiece in each of a multiplicity of planes, angularly displaced from one another about a vertical axis, so as to dynamically vary the orientation of said surface portion and thereby promote migration thereacross of said generated vapor.

2. The method of claim 1 wherein said bottom surface portion is substantially flat.

3. The method of claim 1 wherein said bottom surface portion is generally horizontally oriented in the untilted disposition of said workpiece.

4. The method of claim 1 wherein the dynamic variation of orientation of said surface portion occurs continuously and through an infinite number of said planes of tilting.

* * * * *